US007315770B2

(12) United States Patent
Wade et al.

(10) Patent No.: US 7,315,770 B2
(45) Date of Patent: Jan. 1, 2008

(54) RAILWAY CONTROLLER WITH IMPROVED APPLICATION PROGRAMMING

(75) Inventors: David Justin Wade, Lee's-Summit, MO (US); Shawn T. Clark, Leawood, KS (US); Steve R. Murphy, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 267 days.

(21) Appl. No.: 11/039,643

(22) Filed: Jan. 20, 2005

(65) Prior Publication Data

US 2005/0178928 A1 Aug. 18, 2005

Related U.S. Application Data

(60) Provisional application No. 60/541,437, filed on Feb. 3, 2004.

(51) Int. Cl.
*B61L 1/00* (2006.01)
*G06F 7/00* (2006.01)

(52) U.S. Cl. ..... 701/19; 701/20; 246/1 R

(58) Field of Classification Search ..... 701/19–20; 246/1 C, 14, 20, 122 R, 187 B, 1 R
See application file for complete search history.

(56) References Cited

U.S. PATENT DOCUMENTS

| | | | |
|---|---|---|---|
| 5,029,780 A | 7/1991 | Peel | |
| 6,179,252 B1 | 1/2001 | Roop et al. | |
| 6,241,197 B1 | 6/2001 | Harland | |
| 7,075,427 B1 * | 7/2006 | Pace et al. | 340/539.22 |

(Continued)

FOREIGN PATENT DOCUMENTS

DE 102 20 965 A1 12/2003

(Continued)

OTHER PUBLICATIONS

Laumen H. et al, "Rechnergesteurete Bahnueberganstechnik Bues 2000", Signal+Draht, Telzlaff Verlag GMBH, Darmstadt, DE, vol. 84, No. 6, Jun. 1, 1992, pp. 166-171, XP000297103, ISSN: 0037-4997.

(Continued)

*Primary Examiner*—Yonel Beaulieu
(74) *Attorney, Agent, or Firm*—Carlos Luis Hanze; James H. Beusse; Beusse Wolter Sanks Mora & Maire, P.A.

(57) ABSTRACT

A multi-use wayside railway control system for installation and use in operating wayside railway equipment in a railway wayside application selected from among a plurality of differing railway wayside applications usable in the control system. The system includes detectors responsive to and generating data indicative of operating conditions of the selected wayside application A controller receives data from the detectors and is responsive to the data for operating the wayside equipment. A programmed processor associated with the controller includes a software program storage device for storing a plurality of separately selectable operating programs, each of the operating programs comprising application specific information for a selected wayside application and corresponding configuration of wayside equipment. A control display unit enables selection of one of the stored operating programs compatible with the selected wayside application and corresponding wayside equipment configuration for use by the controller.

4 Claims, 4 Drawing Sheets

U.S. PATENT DOCUMENTS

2002/0096605 A1 7/2002 Berry et al.
2006/0047379 A1* 3/2006 Schullian et al. ..... 701/19

FOREIGN PATENT DOCUMENTS

EP 1 338 492 A1 8/2003
WO WO 98/56635 A 12/1998

OTHER PUBLICATIONS

Gossen, L. et al. "The Bues 2000 In International Use", Signal & Draht, Telzlaff Verlag GmbH, Darmstadt, DE, vol. 93, No. 11, Nov. 2001, pp. 50-52, XP001102719, ISSN:0037-4997.

* cited by examiner

RAILWAY CONTROLLER WITH IMPROVED APPLICATION PROGRAMMING

SPECIFIC DATA RELATED TO THE INVENTION

This application claims the benefit of U.S. provisional application No. 60/541,437, filed Feb. 3, 2004.

FIELD OF THE INVENTION

This invention relates generally to the field of railway equipment, and more particularly to railway wayside equipment and control systems adapted for application specific in situ configuration

BACKGROUND OF THE INVENTION

Railway control equipments, such as wayside signaling equipment, wayside crossing equipment, and wayside interlocking equipment, are individually controlled in a manner to assure that operation of the equipment is suitable for the characteristics and configuration of the application. For example, crossing equipment such as warning lights, warning bells and crossing arms are actuated at different advance distances of an approaching rail vehicle depending upon the speed limit on the railway and the configuration of the crossing, i.e., whether it is single or multiple track crossing and the speed of rail vehicles on the tracks. The control equipment typically includes electronic controllers that are programmed to respond to rail vehicle detectors and actuate the appropriate control equipment, such as by turning on flashing warning lights and lowering crossing arms. The controllers are also used with other wayside equipment such as railway switches to switch rail vehicles to other railways or tracks. The controllers may also control signal lights along the railway which indicate the presence of proximity of a rail vehicle with respect to a defined section or block of railway.

The controllers control the basic functions of the equipment, such as the basic operation of lowering and raising of a crossing gate, in response to programmed information stored in a program storage device such as an erasable programmable read only memory (EPROM) or electrically EPROM (EEPROM). The controllers have unique programs for each application in the form of the equipment to be controlled and the operating environment, such as a timing of a gate lowering upon approach of a train, which may be different depending on where the equipment is located within the railway system, the topography of the crossings, the nature of the railroad tracks (i.e., single or double tracks), the type and age of the equipment at the crossing, etc. Similar domain specific requirements are present for the other types of wayside equipment.

Each of the controllers generally include memory devices, such as EPROMs, for storing respective executive control information and application control information. Executive control information is associated with an executive circuit EPROM that may be programmed with control information common to all of a certain type of equipment, such as all crossing equipment. However, application control information is associated with an application circuit EPROM that typically needs to be programmed with a unique configuration program specifically tailored for a certain application, i.e., an application specific program. Consequently, each type of controller in a railway system may have the same executive EPROM, but each respective controller requires a uniquely programmed application EPROM tailored to a desired application, depending, for example, on how the controller is to be deployed in an installation in a railway system. In the past, quantities of EPROMs were programmed with application specific programs at the railroad company service depot and then provided to installers in batches. Installers of the control equipment, who are not programmers, with a selection of these pre-programmed EPROMs then have the task of picking an EPROM from the selection that has the right program for the specific application of the controller. The ability to make this proper selection is dependent on the information available to the installer to identify the particular EPROM that meets the application requirements. The physical size of the EPROM package limits the amount of written information that can be provided with the EPROM thus making it difficult for the installer to confirm that he/she has selected the correctly programmed EPROM for the particular application.

BRIEF DESCRIPTION OF THE DRAWINGS

The invention will be more apparent from the following description in view of the drawing that shows.

DETAILED DESCRIPTION OF THE INVENTION

Figure 1:
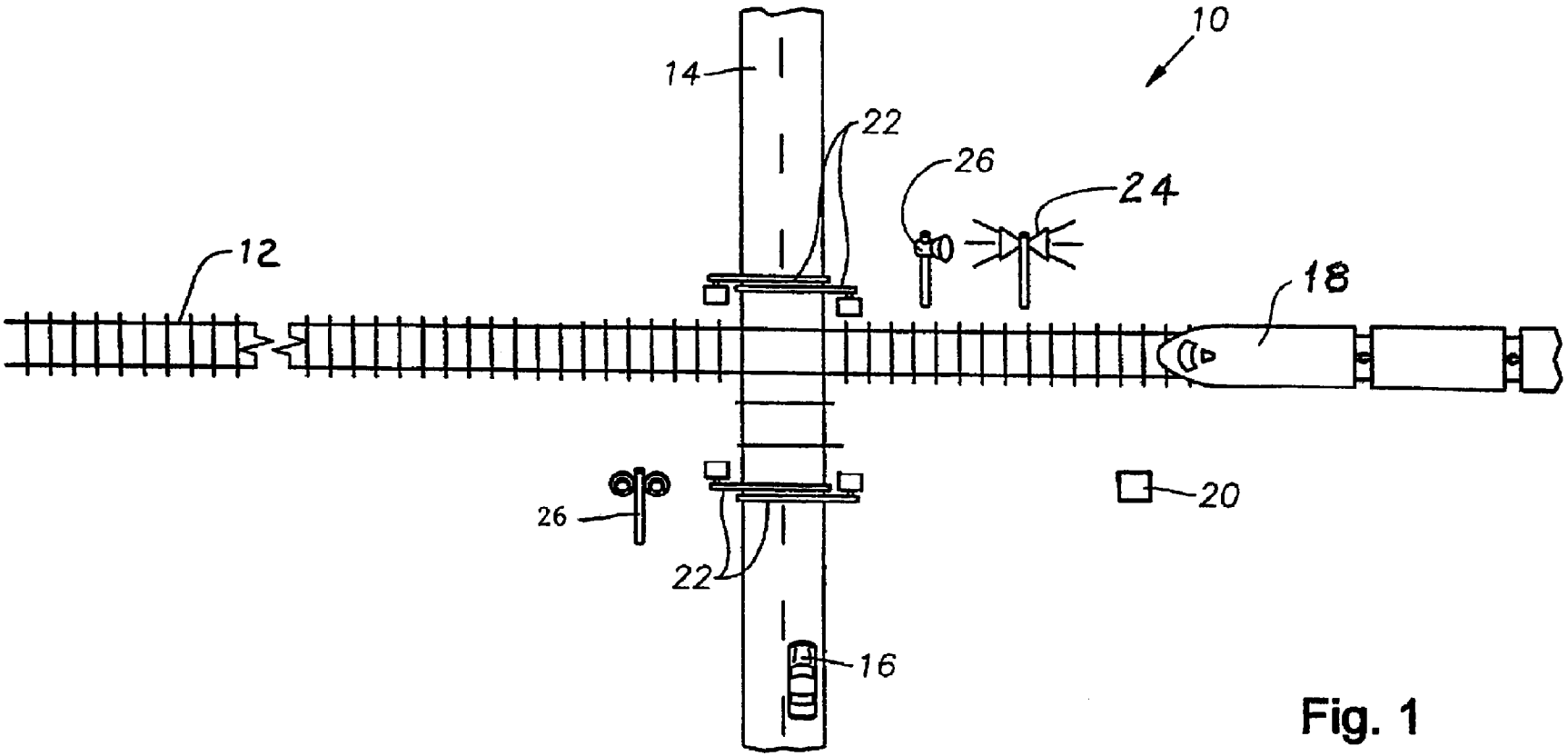
FIG. 1 illustrates an exemplary wayside equipment system.

FIG. 1 illustrates an example of a wayside equipment installation in the form of a detection and warning system for a rail crossing 10. The crossing 10 is formed by a railway (or track) 12 intersecting a roadway 14. A road vehicle 16 is shown on roadway 14 approaching the crossing 10 and a rail vehicle 18 is shown on railway 12 also approaching the crossing. A protective enclosure 20 is located near the crossing for housing a controller for operating the crossing gates 22, signal warning alarm 24 and warning lights 26.

Figure 2:
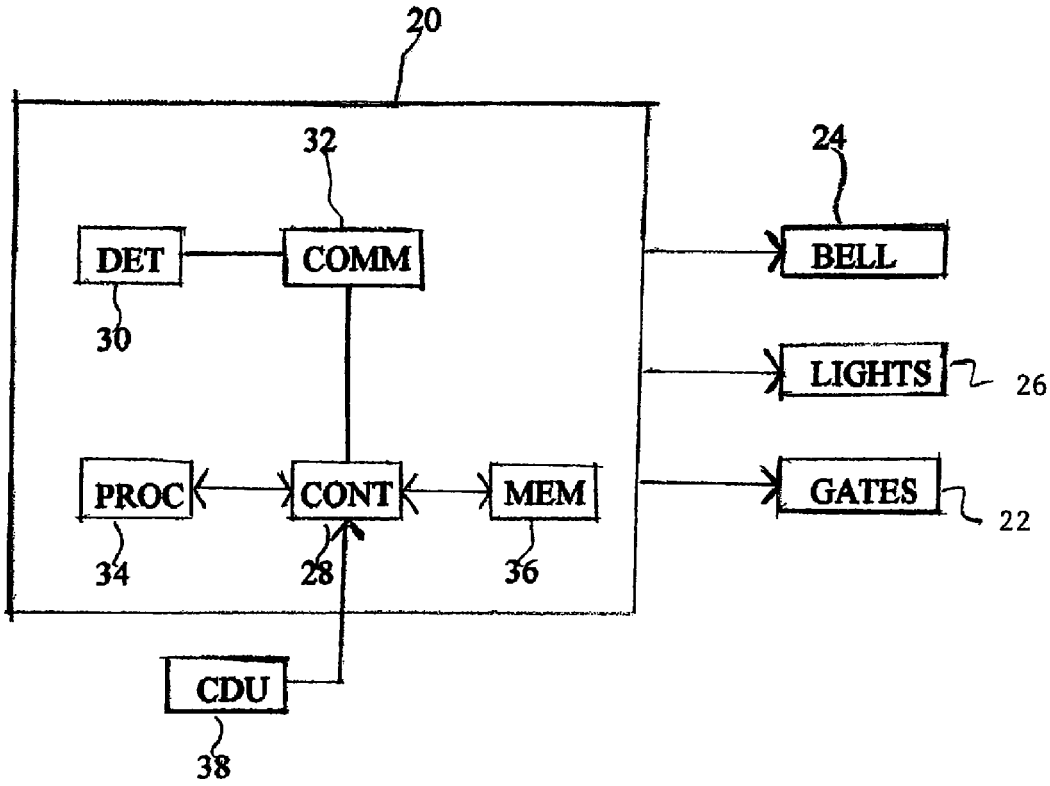
FIG. 2 illustrates a railway equipment controller for use with the present invention.

As shown in FIG. 2, enclosure 20 houses a controller 28, rail vehicle detector 30 and communication interface 32. These elements are well known in the art and function to detect the presence of a rail vehicle and the approach of a rail vehicle toward the crossing 10 and passage of the rail vehicle beyond the crossing. The controller 28 operates the crossing gates 22, warning audio alarm 24 and warning lights 26. Typically, each controller 28 includes a data processor responsive 34 to executive programs stored in a program storage device 36, which device 36 also includes application specific operating parameters or information used by the executive operating program to control the crossing equipment, i.e., bells, lights and crossing arms, in a manner appropriate to that particular crossing. Typically, the devices 30, 32, 34, and 36 are all categorized as a part of the controller 28. While prior systems required different program storage devices for each application, the present invention utilizes a common program storage device incorporating a plurality of different operating program configurations and a control program to allow concatenating the plural programs for individual selection as required for a specific application, such as the crossing 10. In one form, a control display unit (CDU) 38 is connected to controller 28 to allow selection of an appropriate one of the plurality of different operating programs.

As discussed above, each site-specific configuration typically requires a unique application program to control the equipment. A set of common application pre-programmed programs can be developed to cover most configurations of the equipment. For example, a set of 30 such applications may be sufficient to approximate most configurations of crossing equipment anywhere within a rail system. This invention includes a system and method for providing an EPROM that may support different configurations of railway control equipment. The EPROM may be programmed to include different application programs from which a desired configuration program as, appropriate approximation for a specific installation, may be selected when the equipment is installed and operating. In an aspect of invention, different application programs for different equipment that may be controlled by an integrated controller, such as an IWP, may be incorporated in a single application EPROM that includes control information for this set of approximate configurations of the respective equipment. Advantageously, the complexity and the effort required to program the application EPROM of this invention is reduced compared to the prior art technique of uniquely programmed EPROMS required for supporting the railway control equipment used in conventional equipment. While an EPROM memory storage device is described herein, other memory storages devices may be used to practice the invention, such as FLASH memories.

Figure 3:
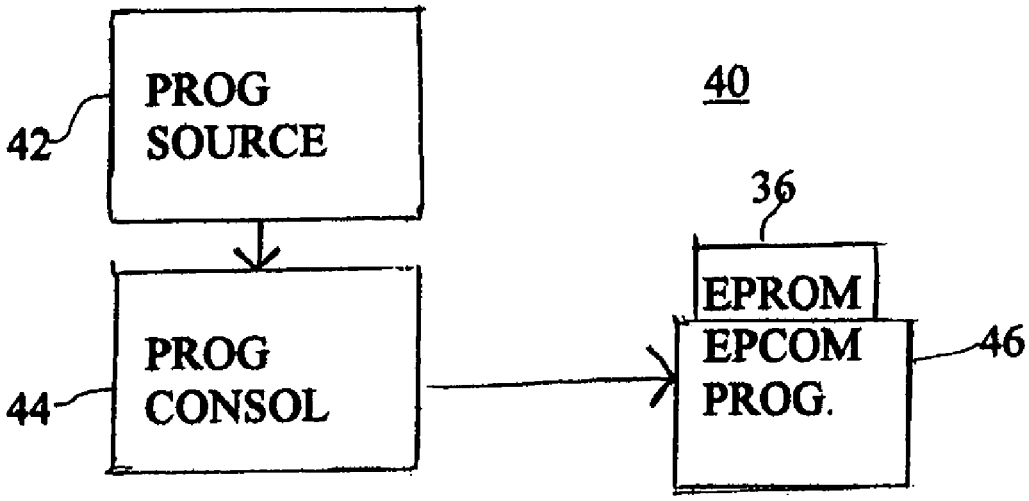
FIG. 3 is a block diagram of a system for consolidating different railway equipment configuration programs into an EPROM.

FIG. 3 is a block diagram of a system 40 for consolidating different railway equipment programs into program storage device 36 which may be an EPROM. Generally, the system 40 includes a program source 42 for developing application programs to control railway equipment, and a program consolidator 44 for allowing selection of appropriate programs and concatenation of selected programs to be stored in the memory device 36. In an aspect of the invention, each application program may include controller configuration information. For example, a set of application programs developed for general configurations of a certain type of equipment may be selected, and the resulting application program may be used universally in that type of domain setting (i.e., operating environment and equipment combination). The device or EPROM 36 may be encoded with programs specifically tailored for a unique application of equipment in a specific installation. The program consolidator 44 may also be configured to compress the selected programs to reduce the amount of storage space required to store the programs and to provide error-correcting information, such as by storing redundant information, or by including cyclic redundancy check (CRC) information. In addition, the program consolidator 44 may be configured to provide an indication of the format of the EPROM 36, and to provide an indication of the number and/or types of programs stored in the application EPROMS. The program consolidator 44 assembles the desired programs and other desired information into an EPROM image for encoding in the EPROM 36. A memory device programmer, such as an EPROM programmer 46, in communication with the program consolidator 44, receives the EPROM image and copies or "burns" the image into the EPROM 36 installed in the programmer 46 typically as a binary image file.

Figure 4:
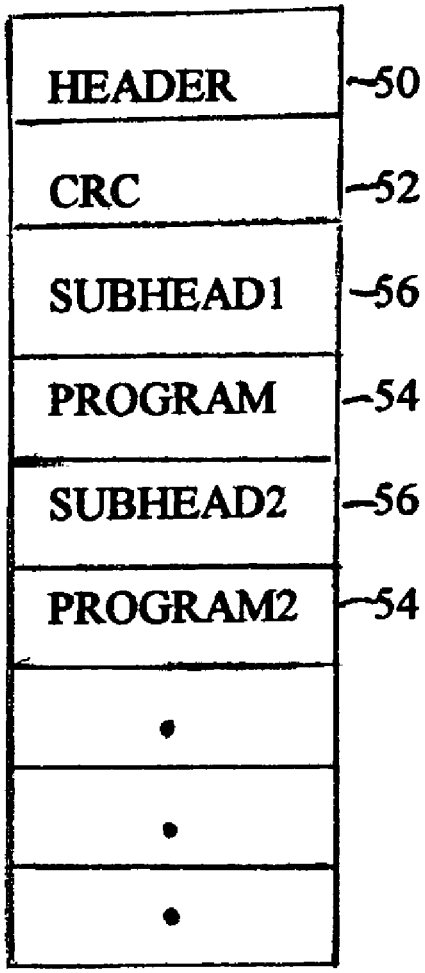
FIG. 4 depicts an exemplary EPROM image format for storing different programs in EPROM memory.

FIG. 4 depicts an exemplary EPROM image format 48 for storing different programs in the EPROM 36. For example, the program consolidator 44 may format the desired information to be stored in the EPROM 36. The EPROM image format 48 may include a header 50 and CRC data 52. The image format 48 may also include at least two concatenated programs 54 that may have subheaders 56 associated with each of the programs 54.

Figure 5:
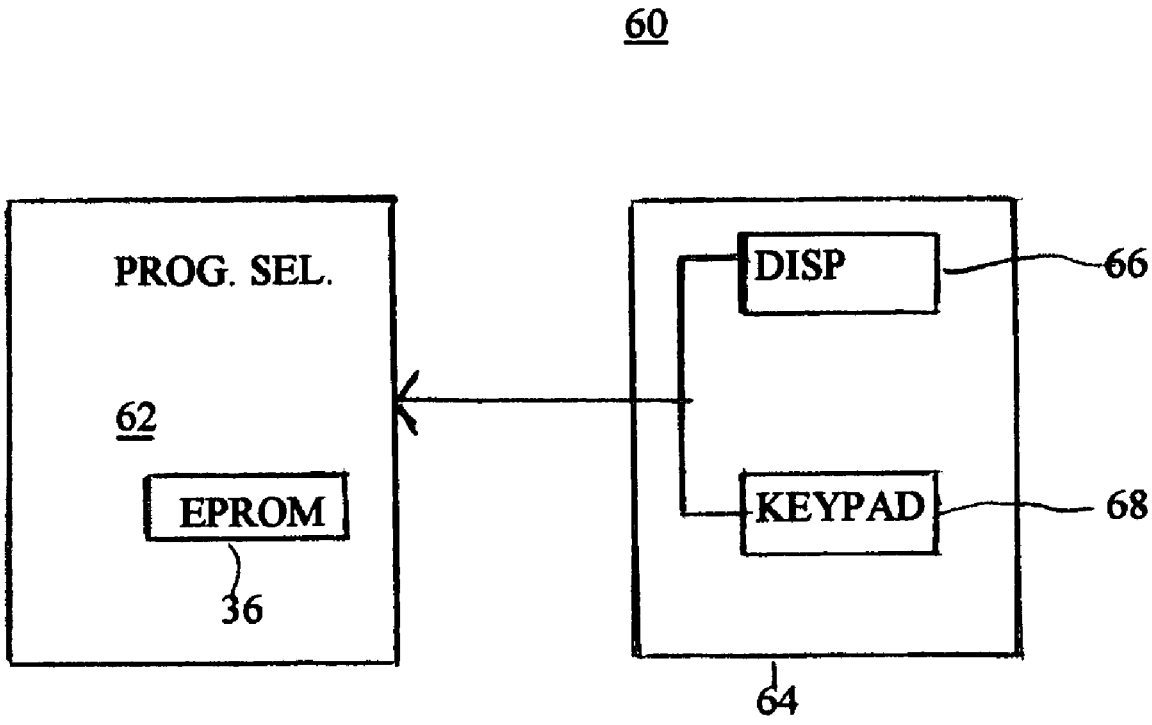
FIG. 5 is a block diagram of a configuration system for selecting desired programs from an EPROM.

FIG. 5 is a block diagram of a configuration system 60 for selecting desired programs from an EPROM 36, for example, installed in a piece of railway equipment such as shown at 20 in FIG. 2. Generally, the configuration system 60 may include an EPROM 36 in communication with a configuration or program selection circuit 62 in communication with the equipment in which the configuration system 60 is installed. The program selection circuit 62 may be in communication with a control interface 64, that may include a display 66 for allowing a user, such as an installer or technician, to view configuration information stored in the EPROM 36, and a keypad 68 for selecting desired configuration programs. The display and keypad may be part of the CDU 38. The program selection circuit 62 may be configured to determine what configuration programs are present in the EPROM, to decompress the programs if required, and to allow the user to select desired configuration programs for configuring the equipment. In another aspect, the program selection circuit 62 may be remotely controllable via the control interface 64, such as over a hardwired link, such as an Internet connection, a radio frequency (RF) link, or an infrared (IR) link to allow remote selection of desired configuration programs. Advantageously, in a consolidated equipment application, a user can program the configuration of each of the component pieces of equipment controlled by the consolidated equipment from a central control point, instead of having to individually configure a controller from a site located at each piece of equipment.

By using the above described system and method, an inventory of application EPROMS may be reduced compared to maintaining a large inventory of uniquely programmed EPROMS as is required conventionally. By encoding multiple applications in a single EPROM, fewer separate EPROM versions may need to be maintained and tracked by the railroad. For example, an application EPROM supporting 30 configurations reduces the inventory from 30 different versions of an EPROM to one version.

In another aspect, updating or revising configurations on-site may be more easily accomplished. For example, if a railroad desires to configure a signaling system to support higher speeds during the summer, when the weather is conducive to higher speeds (such as relatively good visibility), but support lower speeds during the winter when visibility might be impaired, a summer configuration program and a winter configuration program may be stored on one EPROM to allow easier conversion from one program to the other. In an aspect of the invention, the configuration program may be converted by selecting the desired program at the CDU 38 or remotely. In the past, such conversions required either replacing the EPROM with the appropriate EPROM programmed to have a different desired configuration. In yet another aspect, on-site installation configuration may be simplified by being able to select an appropriate approximation program from among a set of approximation programs stored in the EEPROM, eliminating much of the manual programming required to change configuration parameters in conventional equipment. In still another aspect, the EPROM may be electrically programmable/field erasable for ease in adding to or changing the programs stored in the EPROM.

Configuration management of programs installed in the field may be improved, for example, by allowing the configuration system 60 to indicate what application is currently being used. For example, such an indication may be provided on the display 66, printed out, or transmitted to receiver for record keeping. This may reduce the demands to maintain configuration control over multiple EPROMS that might need to be seasonally installed in a piece of equipment. Instead, only one EPROM incorporating multiple configuration programs is required and the appropriate configuration for the equipment may be selected from among the programs stored in that EPROM. In another aspect, to ensure safe operation of the equipment, the programs stored in the EPROM may retain some functions that are not user changeable on-site. This provides an installation site designer a capability to limit the changes that may be made during installation of the equipment to only specified parameters that are allowed to be changed. In a further aspect, a user may be allowed to make certain changes, but the changes may be limited, for example, to specific ranges of selections. For instance, an approach distance value selection may be limited to a range between 2000 and 3000 feet, rather than values outside this range.

In the past, to provide field configurability, one application EPROM may have been encoded to provide different configurations depending on how certain inputs, such as enable inputs, were wired to the EPROM. On-site, these inputs were wired to a certain state to achieve a desired configuration. Using an innovatively programmed EPROM supporting multiple configurations, time consuming field parameter setup may be reduced in that the pre-programmed approximation programs are also pre-tested, so that only the additional programming requires testing as part of the installation. In addition, design and testing times may be reduced, as only a new program needs to be tested, instead of having to test a new program and all configurations that the program may be wired to perform, as was required in the past. Furthermore, with the addition of error checking to the EPROM, if an EPROM program is changed to include different or additional applications, only the added or modified applications must be retested, not all the applications.

While the preferred embodiments of the present invention have been shown and described herein, it will be obvious that such embodiments are provided by way of example only. Numerous variations, changes and substitutions will occur to those of skill in the art without departing from the invention herein.

What is claimed is:

1. A multi-use wayside railway control system for installation and use in operating wayside railway equipment in a railway wayside application selected from among a plurality of differing railway wayside applications usable in the control system comprising:

(A) detectors responsive to and generating data indicative of operating conditions of the selected wayside application, with the data being transmitted to a controller;

(B) the controller receiving data from the detectors and being responsive to the data for operating the wayside equipment;

(C) a software program responsive processor operatively associated with the controller;

(D) a software program storage device coupled to the processor and storing a plurality of separately selectable operating programs, each of the operating programs comprising application specific information for a selected wayside application and corresponding configuration of wayside equipment; and (E) a control display unit connectible to the program storage device for displaying information indicative of and for enabling selection of one of the stored operating programs compatible with the selected wayside application and corresponding wayside equipment configuration.

2. The multi-use wayside railway control system of claim 1 wherein the control display unit is utilized at initial setup to select one of the stored operating programs and the controller thereafter uses the selected one of the operating programs for controlling the wayside equipment.

3. The multi-use wayside railway control system of claim 2 wherein the program storage device comprises an EPROM.

4. The multi-use wayside railway control system of claim 3 wherein the wayside equipment comprises crossing gates and warning signals at a railway crossing of a roadway.

* * * * *